United States Patent [19]

Kolton et al.

[11] Patent Number: 5,005,741

[45] Date of Patent: Apr. 9, 1991

[54] FOLDED TAIL BELT HANGER WITH ENHANCED BELT RETENTION

[75] Inventors: Chester Kolton, Westfield; Stuart S. Spater, Livingston, both of N.J.

[73] Assignee: B & G Plastics, Inc., New York, N.Y.

[21] Appl. No.: 462,060

[22] Filed: Jan. 8, 1990

[51] Int. Cl.[5] ..... A47G 25/14

[52] U.S. Cl. ..... 223/85; 223/87; 223/89

[58] Field of Search ..... 223/85, 87, 89; 411/508, 509, 510, 512, 913, 339; 24/16 PB, 30 SP, 662

[56] References Cited

U.S. PATENT DOCUMENTS

| | | | |
|---|---|---|---|
| 2,943,373 | 7/1960 | Rapata | 24/662 |
| 3,009,381 | 11/1961 | Rapata | 411/508 |
| 3,710,996 | 1/1973 | Smilow et al. | 223/87 |
| 4,063,669 | 12/1977 | Smilow et al. | 223/87 |
| 4,453,655 | 6/1984 | Smilow et al. | 211/113 |

FOREIGN PATENT DOCUMENTS

| | | | |
|---|---|---|---|
| 787820 | 12/1957 | United Kingdom | 24/662 |
| 921790 | 3/1963 | United Kingdom | 24/662 |
| 982259 | 2/1965 | United Kingdom | 411/512 |

*Primary Examiner*—Werner H. Schroeder
*Assistant Examiner*—Bibhu Mohanty
*Attorney, Agent, or Firm*—Robin, Blecker, Daley & Driscoll

[57] ABSTRACT

A belt hanger is comprised of an integral body defining a hook portion for use with a display rod and a further portion adapted to be folded on itself to form a loop, the body being generally planar and existing largely between a front planar surface and a rear planar surface, the further portion having a projection extending forwardly of the front surface, the body defining a cavity at least in part rearwardly of the rear surface for retentive receipt of the projection.

20 Claims, 2 Drawing Sheets

FOLDED TAIL BELT HANGER WITH ENHANCED BELT RETENTION

FIELD OF THE INVENTION

This invention relates generally to hangers for the display of articles and pertains more particularly to improved hangers for the display of belts of the so-called "folded tail" type.

BACKGROUND OF THE INVENTION

For many years, the belt industry employed a belt hanger of the type employing a flat body of cardboard, and later of plastic, defining an upper hook portion for applying the hanger to a display rod, a central or body portion depending from the hook portion, and a lower or tail portion suspended from the body portion and defining an inverted T-shaped opening. In use of such hangers, the tail portion was inserted into the frame of a belt buckle and the prong of the buckle was nested in the T-shaped opening, the belt thereby being hung from the display rod, however at an angle to the vertical.

Disadvantage attended such off-vertical belt hanging to the extent that fewer belts could be displayed per lineal dimension of the display rod than would apply were the belt to be hung in truly vertical manner. A further disadvantage of such known hangers, later to be referred to as so-called "short tail" or "unfolded tail" hangers, was that the buckle could be readily separated from the hanger. Such separation occurred innocently in the course of a customer applying the belt across his or her waist, but sometimes was fraudulent in instances wherein the hanger included pricing data and the customer desired to shift a hanger for a less expensive belt to a hanger for a more expensive belt.

Solutions to the foregoing problems were presented in the invention disclosed in commonly-assigned U.S. Pat. No. 3,710,996. Therein, a belt hanger structure was disclosed of so-called "folded tail" type, wherein the hook portion continued to suspend therefrom the body portion, but wherein the body portion suspended therefrom a tail portion in the form of a strap defining the inverted T-shaped opening medially thereof, the strap being adapted to be folded about the bottom of the T-shaped opening. The terminal folded part of the tail portion carried a projection and the starting portion of the tail or body portion defined an opening adapted for interference-fit receipt of the projection.

Such projection-receiving opening was fully within the hanger in its planar, unfolded state and, with close dimensioning of the opening, the projection, once inserted, could not be released from retention therein by hand. Accordingly, release of the hanger from the belt, innocently or with fraudulent intent, could not be readily realized. Further, since the hanger defined the fold line of the folded tail coincidently with the median thereof, true vertical hanging of hangers and belts secured therein was to be attained, increasing the density of belts which could be hung per unit lineal dimension of the display rod.

In the course of usage of the belt hangers of the '996 patent, belt manufacturers came to look to the latter advantage more than to the former advantage, since the former advantage was fully realized only upon essentially equal insertion and withdrawal forces being involved in use thereof. Thus, belt manufacturers came to witness an assembly labor problem wherein the person applying the hanger to the belt could not readily accomplish the assembly without resort to accessory tooling providing a mechanical advantage. Accordingly, manufacturing comprise was struck as between the insertion and retention forces, giving rise to the continued possiblity of fraudulent removal of the hangers from the belts.

By way of further background to the present invention, the belt industry came subsequently to look to the hanging of belts having so-called "stud belt buckles" and a recognition of the problem inherent therein when the short tail hanger was used to hang the same. Here, it was found that the stud, which projected outwardly of the buckle on its underside and was inserted into the T-shaped opening of the short tail hanger, was exposed such that it could mar adjacently hung stud buckles of belts.

In commonly-assigned U.S. Pat. No. 4,063,669, a solution was found for this problem, namely, by disposing the stud of a buckle of a belt to be hung interiorly aside a course of the folded tail of the '996 patent structure.

While the structure of the '669 patent provided for retention of the stud in the keyhole opening provided therein, the insertion force involved in retention of the folded tail in locked, folded condition, again as in the case above discussed of the '996 patent, was essentially equal to the insertion force, continuing the comprise as between practical insertion force and practical retention force.

The '996 and '669 patents have been held to be valid in litigation on infringement thereof, as is reported in 691 F. Supp. 741 (SDNY 1988), the Court noting the foregoing advantages in its decision.

The belt hanging industry has come recently to look to an enhanced retention of folded tail hangers with belts hung thereby. Particularly, the extant compromise as between insertion force and retention force has become an unacceptable compromise.

SUMMARY OF THE INVENTION

It is an object of the present invention to overcome the foregoing disadvantage of extent known folded tail hangers for the hanging of belts.

A more particular object of the invention is the provision of improved folded tail belt hangers which afford an enhanced retention force as against the insertion force for the tail portion projection.

As a more general object, the invention looks to provide garment hangers of folded-tail type wherein the force involved in assembly of the hanger with a garment is substantially less than the force involved in disassembly of the hanger from joinder with the garment.

In the attainment of the last-mentioned general object, the invention provides a hanger comprised of an integral body defining a hook portion for use with a display rod and a further portion adapted to be folded on itself to form a loop, the body being generally planar and existing largely between a front planar surface and a rear planar surface, the further portion having a projection extending forwardly of the front surface, the body defining a cavity at least in part rearwardly of the rear surface for retentive receipt of the projection.

In the preferred embodiment, the projection defines a locking member at a free end thereof and a shank intermediate the locking member and the further portion, the locking member exhibiting a maximum cross-sectional dimension for the projection and the shank exhibiting a cross-sectional dimension less than the maximum cross-sectional dimension.

The cavity exhibits a first cross-sectional dimension at the front surface substantially equal to the locking member maximum cross-sectional dimension and a second cross-sectional dimension substantially equal to the shank cross-sectional dimension rearwardly of the rear surface. The cavity first cross-sectional dimension and the locking member maximum cross-sectional dimensions are preferably respective first diameters and the shank cross-sectional dimension and the cavity second cross-sectional dimension are respective second diameters. The cavity is bounded by a tapered interior surface of the body extending from the cavity first diameter to the cavity second diameter.

In more specific aspect, the invention provides a garment hanger comprised of an integral body defining a hook portion for use with a display rod and a further portion adapted to be folded on itself to form a loop, the body being generally planar and existing largely between a front planar surface and a rear planar surface, the further portion having a projection extending forwardly of the front surface, the body defining a cavity at least in part rearwardly of the rear surface for retentive receipt of the projection, the cavity having a first cross-sectional dimension in the front surface and extending into the body at the first cross-sectional dimension and having a second cross-sectional dimension less than the first cross-sectional dimension at the part thereof rearwardly of the rear surface.

The foregoing and other objects and features of the invention will be further understood from the following detailed discussion of preferred embodiments thereof and from the drawings wherein like reference numerals identify like components and part throughout.

DESCRIPTION OF THE PREFERRED EMBODIMENT AND PRACTICE

Figure 1:
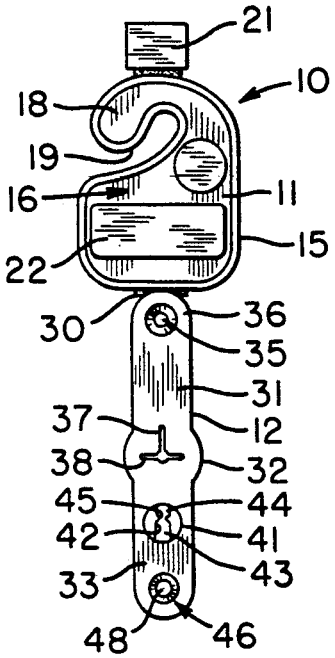
FIG. 1 (PRIOR ART)
FIG. 1 depicts, in front elevation, the hanger of the '669 patent.
Figure 2:
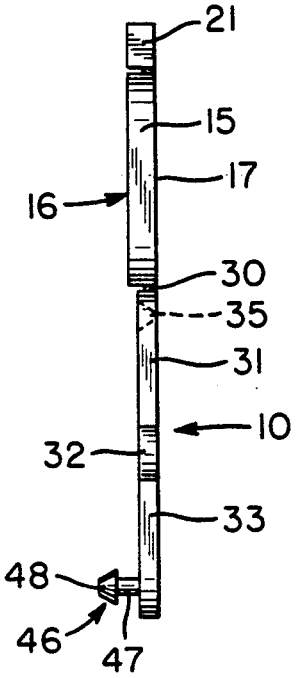
FIG. 2 (PRIOR ART)
FIG. 2 is a right side elevation of the hanger of FIG. 1.

Referring to FIGS. 1 and 2, hanger 10 is formed preferably as a molded plastic member and comprises a main body portion 11 and a foldable tail, or loop-forming portion 12. Body portion 11 is of generally rectangular configuration and is bounded by a continuous peripheral edge 15, as well as a front surface 16 and a rear surface 17. A hook portion 18 overlies a correspondingly shaped recess 19, permitting the hanger to be engaged upon a display rod, to be hung therefrom. Extending upwardly from hook portion 18 is an optional size-indicating tab 21. Price and logo display areas 22 and 23 may be provided, as desired.

Foldable tail portion 12 interconnects at one end with depending tab 30 and includes a first elongated section 31, a bend section 32, and a second elongated section 33. The section 31 includes a generally circular opening 35 at an upper end 36. The lower end adjacent the bend section 32 includes a slot-like opening 37 communicating with a transverse opening 38 forming means for engaging the conventional prong and center bar type of belt buckle, with which the hanger may be selectively used.

The second elongated section 33 is of configuration generally similar to that of the first portion 31, and includes a generally circular area 41 of increased thickness enclosing a keyhole-shaped through opening 42 including a larger portion 43 and a small portion 44 separated by projections 45. A locking projection 46 engages the opening 35 in a manner as taught in the '996 patent above-referenced. Projection 46 has a shank 47, extending generally orthogonally, outwardly of hanger 10, and a locking member 48 of diameter exceeding that of shank 47. Normally the engagement of projection 46 in opening 35 to form a loop is made after the conventional belt buckle has been engaged. Where the hanger is used in conjunction with stud and channel buckles, the loop may for formed prior to engagement of the hanger with the buckle.

Phantom lines in FIG. 2 indicate the nature of opening 35, i.e., it tapers from the front surface of first elongated section 31 to an opening of lesser dimension at the rear surface of section 31.

Figure 4:
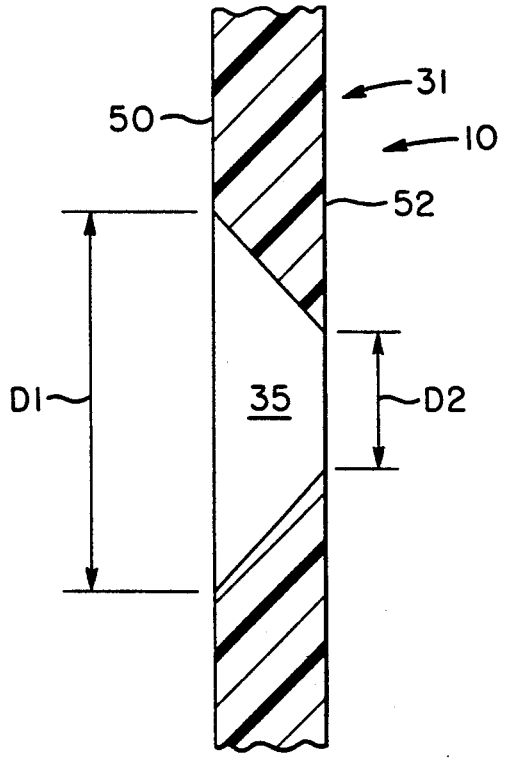
FIG. 4 (PRIOR ART)
FIG. 4 is an enlarged sectional view of the projection-receiving cavity of the FIG. 1 hanger.

Referring now to FIG. 4, an enlarged and partial cross-section of the phantom showing of FIG. 2 is depicted. Section 31 is thus shown as having front planar surface 50 and rear planar surface 52. Opening 35 is of diameter D1 in surface 50, corresponding with the outer diameter of locking member 48, and is of diameter D2 in surface 52, corresponding with the outer diameter of shank 47. Of consequence, for reasons below discussed, it is to be noted that the prior art hanger disposed the projection-receiving cavity fully within the bounding planar surfaces 50 and 52 thereof.

Figure 3:
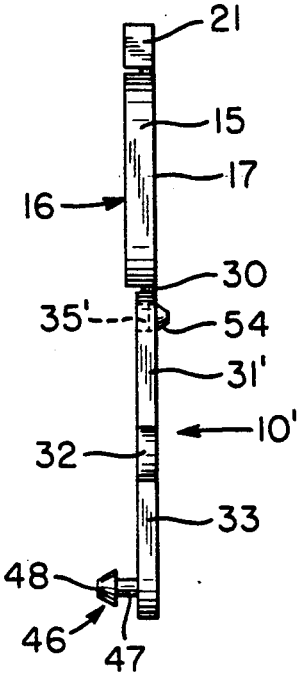
FIG. 3 is a right side elevation of a hanger in accordance with the present invention.
Figure 5:
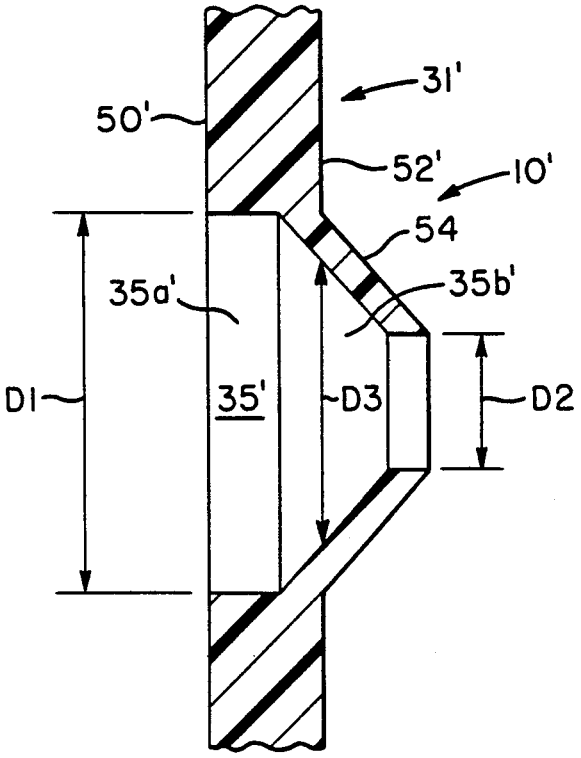
FIG. 5 is an enlarged section view of the projection-receiving cavity of the FIG. 3 hanger.

FIGS. 3 and 5 depict the hanger 10' of the subject invention respectively in side elevation and in enlarged and partial cross-section of the section 31' thereof, which is akin to section 31 of the prior art hanger. Section 31' is thus shown as having front planar surface 50' and rear planar surface 52'. Opening 35' is of diameter D1 in surface 50', corresponding with the outer diameter Dl of locking member 48. Unlike opening 35, opening 35' extends initially in course **35*a'* thereof at diameter D1 within section 31' to an ending location between surface 50'and surface 52'. At such ending location of the initial course 35*a'* opening 35', opening 35' tapers in course 35*b'* thereof to diameter D2 at a location distal from surface 52', i.e., outwardly thereof, defining hanger outwardmost wall part 54**.

In contrast to the aforementioned compromise as between assembly and retention forces attending projection 46 and cavity 35 of the prior art, the diameter of opening 35' in surface 52'has been enlarged in the present invention to a dimension D3, where D3 is less than dimension D1, but greatly in excess of dimension D2. Insertion force for assembly is accordingly reduced. Concomittantly, however, the disassembly force, i.e., the force overcoming the retention of the assembly, is decreased, as is now discussed.

From applicants' observations and considerations, the insertion force, in the outset arrangement providing equalization between insertion and disassembly forces, the problem was bottomed in the fact that the opening was fully contained within the planar front and rearward sides of the section 31. This demanded that insertion be attended by the displacement of structure bounding opening 35 which was fully contained within the hanger planar body. To the contrary, in the embodiment of FIGS. 3 and 5, insertion is attended by the circumstance that the displacement of structure bounding opening 35', i.e., hanger outwardmost wall part 54, is not constrained at all by the otherwise hanger planar body.

It is found that, by reason of such projection-receiving cavity structure, wherein one course of the cavity is of the dimension of the maximum cross-section of the hanger projection and is at least partly within the hanger planar body and wherein another course of the projection-receiving cavity extends at least in part outwardly of the hanger planar body and exhibits an outward end opening of the minimum cross-section of the hanger projection, insertion assembly force is substantially less than disassembly or retention force. Thus, in the course of assembly, i.e., in folding the hanger tail about itself and inserting the tail projection 46 into the projection-receiving cavity configured in accordance with the invention, such as cavity 35', hanger outwardmost wall part 54 distends, or expands radially, without constraint from the remainder of the hanger body. On the other hand, in efforts to remove the projection 46 from such retained assembly with cavity 35' and wall part 54, wall part 54 collects unto itself, deforming from the depicted taper into a more dense accumulation of matter of wall part 54 closer to the rearward wall of the hanger, greatly increasing disassembly force, and largely denying disassembly in the absence of disassembly tooling, e.g., means cutting the shank of the projection fully.

Various changes to the illustrated embodiment and modifications in practice may evidently be introduced without departing from the invention. Accordingly, it is to be appreciated that the particularly discussed and depicted preferred embodiment and practice of the invention are intended in an illustrative and not in a limiting sense. The true spirit and scope of the invention are set forth in the ensuing claims.

We claim:

1. A hanger comprised of an integral body defining a hook portion for use with a display rod and a further portion adapted to be folded on itself to form a loop, said integral body having a front planar surface and a rear planar surface, said further portion having a projection extending forwardly of said front planar surface, said integral body having an additional portion extending rearwardly of said rear planar surface and defining a cavity for retentive receipt of said projection, said cavity extending from said front planar surface beyond said rear planar surface and through said additional portion.

2. The hanger claimed in claim 1 wherein said projection defines a locking member at an end thereof and a shank intermediate said locking member and said further portion, said locking member exhibiting a maximum cross-sectional dimension for said projection and said shank exhibiting a cross-sectional dimension less than said maximum cross-sectiona dimension.

3. The hanger claimed in claim 2 wherein said cavity exhibits a first cross-sectional dimension at said front planar surface substantially equal to said locking member maximum cross-sectional dimension and a second cross-sectional dimension substantially equal to said shank corss-sectional dimension in said additional portion.

4. The hangar claimed in claim 3 wherein said cavity first cross-sectional dimension and said locking member maximum cross-sectional dimension are respective first diameters and wherein said shank cross-sectional dimension and said cavity second cross-sectional dimensional are respective second diameters.

5. The hanger claimed in claim 4 wherein said cavity is bounded by a tapered interior surface of said body extending from said cavity first diameter to said cavity second diameter.

6. A hanger comprised of an integral body defining a hook portion for use with a display rod and a further portion adapted to be folded on itself to form a loop, said further portion having a front planar surface and a rear planar surface, said front planar surface, said further portion also having a part thereof extending rearwardly of said rear planar surface and defining a cavity for retentive receipt of said projection, said cavity extending from said front planar surface beyond said rear planar surface and through said part of said further portion.

7. The hanger claimed in claim 6 wherein said projection defines a locking member at an end thereof and a shank intermediate said locking member and said further portion, said locking member exhibiting a maximum corss-sectional dimension for said projection and said shank exhibiting a cross-sectional dimension less than said maximum cross-sectional dimension.

8. The hanger claimed in claim 7 wherein said cavity exhibits a first cross-sectional dimension at said front planar surface substantially equal to said locking member maximum cross-sectional dimension and a second cross-sectional dimension substantially equal to said shank cross-sectional dimension in said part of said further portion.

9. The hanger claimed in claim 8 wherein said cavity first cross-sectional dimension and said locking member maximum cross-sectional dimension are respective first diameters and wherein said shank cross-sectional dimension and said cavity second cross-sectional dimension are respective second diameters.

10. The hanger claimed in claim 9 wherein said cavity is bounded by a tapered interior surface of said further portion extending from said cavity first diameter to said cavity second diameter.

11. A hanger comprised of an integral body defining a hook portion for use with a display rod and a further portion adapted to be folded on itself to form a loop, said integral body having a front planar surface and a rear planar surface, said further portion having a projection extending forwardly of said front planar surface, said integral body having an additional portion extending rearwardly of said rear planar surface and defining a cavity for retentive receipt of said projection, said cavity having a first cross-sectional dimension in said front planar surface and extending into said body at said first cross-sectional dimension and having a second cross-sectional dimension in said additional portion.

12. The hanger claimed in claim 11 wherein said projection defines a locking member at an end thereof and a shank intermediate said locking member and said further portion, said locking member exhibiting a maximum cross-sectional dimension for said projection and said shank exhibiting a cross-sectional dimension less than said maximum cross-sectional dimension.

13. The hanger claimed in claim 12 wherein said cavity first cross-sectional dimension is substantially equal to said locking member maximum cross-sectional dimension and said cavity second cross-sectional dimension is substantially equal to said shank cross-sectional dimension.

14. The hanger claimed in claim 13 wherein said cavity first cross-sectional dinmension and said locking member maximum cross-sectional dimension are respective first diameters and wherein said shank cross-sectional dimension and said cavity second cross-sectional dimension are respective second diameters.

15. The hanger claimed in claim 14 wherein said cavity is bounded by a tapered interior surface of said further portion extending from said cavity first diameter to said cavity second diameter.

16. A hanger comprised of an integral body defining a hook portion for use with a display rod and further portion adapted to be foled on itself to form a loop, said further portion having a front planar surface and a rear planar surface, said further portion having a projection extending forwardly of said front planar surface, said further portion also having a part thereof extending rearwardly of said rear planar surface and defining a cavity for retentive receipt of said projection, said cavity having a first cross-sectional dimension in said front planar surface and extending into said further portion at siad first cross-sectional dimension and having a second cross-sectional dimension in said part of said further portion.

17. The hanger claimed in claim 16 wherein said projection defines a locking member at an end thereof and a shank intermediate said locking member and said further portion, said locking member exhibiting a maximum cross-sectional dimension for said projection and said shank exhibiting a cross-sectional dimension less than said maximum cross-sectional dimension.

18. The hanger claimed in claim 17 wherein said cavity first cross-sectional dimension is substantially equal to said locking member maximum cross-sectional dimension and said cavity second cross-sectional dimension is substantially equal to said shank cross-sectioanl dimension.

19. The hanger claimed in claim 18 wherein said cavity first cross-sectional dimension and said locking member maximum cross-sectional dimension are respective first diameters and wherein said shank cross-sectional dimension and said cavity second cross-sectional dimension are respective second diameters.

20. The hanger claimed in claim 19 wherein said cavity is bounded by a tapered interior surface of said further portion extending from said cavity first diameter to said cavity second diameter.

* * * * *

UNITED STATES PATENT AND TRADEMARK OFFICE

CERTIFICATE OF CORRECTION

PATENT NO. : 5,005,741

DATED : April 9, 1991

INVENTOR(S) : Chester Kolton and Stuart S. Spater

It is certified that error appears in the above-identified patent and that said Letters Patent is hereby corrected as shown below:

Col. 2, line 43. Change "extent" to -- extant --

Col. 4, line 20. Change "for" to -- be --

Col. 4, line 48. After "35a'" insert -- of --

Col. 5, line 61. Change "cross-sectiona" to -- cross-sectional --

Col. 5, line 67. Change "corss-sectional" to -- cross-sectional --

Col. 6, line 6. Change "sional" to -- sion --

Col. 6, line 15. After "surface," insert -- said further portion having a projection extending forwardly of --

Col. 6, line 26. Change "corss-sectional" to -- cross-sectional --

Col. 7, line 26. Change "siad" to -- said --

Col. 8, line 14. Change "cross-sectioanl" to -- cross-sectional --

Signed and Sealed this

Twenty-second Day of September, 1992

*Attest:*

DOUGLAS B. COMER

*Attesting Officer*

*Acting Commissioner of Patents and Trademarks*